US012514351B1

(12) United States Patent
Li

(10) Patent No.: US 12,514,351 B1
(45) Date of Patent: Jan. 6, 2026

(54) CARD PACK

(71) Applicant: Chuncan Li, Zhengzhou (CN)

(72) Inventor: Chuncan Li, Zhengzhou (CN)

( * ) Notice: Subject to any disclaimer, the term of this patent is extended or adjusted under 35 U.S.C. 154(b) by 93 days.

(21) Appl. No.: 18/953,185

(22) Filed: Nov. 20, 2024

(51) Int. Cl.
*A45C 11/18* (2006.01)
*A45F 5/02* (2006.01)

(52) U.S. Cl.
CPC ..... *A45C 11/182* (2013.01); *A45F 5/021* (2013.01)

(58) Field of Classification Search
CPC ..... A45C 11/182; A45C 11/00; A45F 5/021; A45F 5/00
USPC ..... 150/149; 16/221
See application file for complete search history.

(56) References Cited

U.S. PATENT DOCUMENTS 12,201,200 B1 * 1/2025 Nikolaev ..... A45C 11/182
2002/0074246 A1 * 6/2002 Tiscione ..... A45F 5/00 206/556
2010/0095483 A1 * 4/2010 Brown ..... F16M 11/2021 16/221
2015/0208778 A1 * 7/2015 Velentzas ..... A45C 11/182 150/147
2015/0282580 A1 * 10/2015 Chen ..... A45C 11/182 206/425
2019/0296788 A1 * 9/2019 Zavala ..... A45C 1/08

FOREIGN PATENT DOCUMENTS

CN 210747750 U * 6/2020
WO WO-2011067981 A1 * 6/2011 ..... A45C 11/182
WO WO-2017201863 A1 * 11/2017

* cited by examiner

*Primary Examiner* — Nathan J Jenness
*Assistant Examiner* — Jessica Kavini Tamil
(74) *Attorney, Agent, or Firm* — Sandy Lipkin

(57) ABSTRACT

A card pack is provided, which includes a housing, a pushing mechanism, and a cover plate. The housing has a storage cavity for storing multiple stacked cards and is provided with an opening structure that communicated with the storage cavity; the pushing mechanism is provided in the storage cavity and is configured to push out the multiple cards from the storage cavity to an outside of the storage cavity; the cover plate is connected to an outer side wall of the housing and is connected to the pushing mechanism; when the cover plate is rotated, the cover plate drives the pushing mechanism to push out the multiple cards from the storage cavity to the outside of the storage cavity. The storage cavity can conveniently store multiple cards. The opening structure facilitates the entry and exit of the cards and plays a role of fixing the cards.

13 Claims, 13 Drawing Sheets

CARD PACK

TECHNICAL FIELD

The present disclosure relates to the field of card packs technologies, and in particular, to a card pack

BACKGROUND

Card pack is a small storage tool specifically designed to store various types of cards such as bank cards, credit cards, ID cards, membership cards, etc. People frequently use various cards for transactions and service authentication in their daily lives, rendering the card pack is one of the essential carry-on items for modern people when going out.

Traditional leather card packs have multiple card pockets to accommodate them. During the use of the leather card pack, the user needs to insert the cards into an empty card pocket one by one, and also needs to extract the cards from the card pocket one by one.

However, the card pocket of the card pack is often designed to be relatively small in order to stably store the cards, which also leads to inconvenience when retrieving and placing cards in leather card packs.

SUMMARY

The purpose of the present disclosure is to solve the technical problem of inconvenient card retrieval and placement in card packs and provide a card pack.

In order to solve the above problems, the present disclosure is implemented according to the following technical solution.

A card pack, including:

a housing, the housing includes a storage cavity configured to store multiple stacked cards, the housing is provided with an opening structure that communicates with the storage cavity;

a pushing mechanism, which is provided in the storage cavity of the housing and is configured to push out the multiple cards from the storage cavity to an outside of the storage cavity;

a cover plate, which is connected at an outer side wall of the housing and is connected to the pushing mechanism; when the cover plate is rotated, the cover plate drives the pushing mechanism to push out the multiple cards from the storage cavity to the outside of the storage cavity.

In some embodiments of the present disclosure, an inner wall of the opening structure of the housing is connected with a limit piece that is capable of being swung elastically, and the limit piece has an avoidance state and a limit state that are mutually switched;

in the avoidance state, the limit piece allows the cards to be stretched out from the opening structure;

in the limit state, the limit piece is configured to prevent the cards from being fallen out from the storage cavity.

In some embodiments of the present disclosure, a side wall of the storage cavity of the housing is connected to a contact piece, which is configured to contact side walls of the multiple cards in the storage cavity, and a friction between the housing and the cards is increased through the contact piece.

In some embodiments of the present disclosure, the pushing mechanism includes:

a mechanical gear, which is movably connected to the storage cavity of the housing and is connected to the cover plate;

a swing arm, which is hinged to the housing and is meshed with the mechanical gear for transmission, and the swing arm has an initial state and a working state;

when the cover plate is rotated and the mechanical gear is driven, the mechanical gear drives the swing arm to switch between a pushing state and a reset state;

when the swing arm is in the initial state, the multiple cards are stored in the storage cavity of the housing;

when the swing arm is the working state, it pushes out the multiple cards from the storage cavity to the outside of the storage cavity.

In some embodiments of the present disclosure, the cover plate includes a transmission shaft, the cover plate drives the mechanical gear through the transmission shaft;

where the transmission shaft is sleeved with a torsion spring, and the torsion spring abuts against an inner wall of the housing, the torsion spring is configured for an elastic reset of the cover plate.

In some embodiments of the present disclosure, the swing arm includes a pushing part with a stepped structure, and the pushing part has multiple steps, each step of the pushing part correspondingly contacts one card and pushes out one card;

when the swing arm is in the working state, the pushing part causes the multiple cards to be stretched out successively from the storage cavity, and lengths of the multiple cards that are stretched out from the storage cavity are different.

In some embodiments of the present disclosure, the housing further includes:

a perforation, the transmission shaft is connected to the mechanical gear through the perforation, a first slide rail and a second slide rail that are arranged in an arc line.

In some embodiments of the present disclosure, the cover plate further includes:

a slider installation part; and a first slider, which is cooperated with the second slide rail to guide a rotation of the cover plate.

In some embodiments of the present disclosure, an interior of the housing is provided with a second slider, which passes through the first slide rail and is connected to the slider installation part on the cover plate;

the second slider is configured to guide the cover plate to slide back and forth along the first slide rail and the second slide rail;

a displacement distance of the cover plate is determined by lengths of the first slide rail and the second slide rail.

In some embodiments of the present disclosure, the inner wall of the housing includes a limit block; one end of the torsion spring is matched with the limit block, and the other end of the torsion spring is matched with the first slider, the torsion spring is compressed by rotating the cover plate;

when in the working state, the torsion spring is compressed.

In some embodiments of the present disclosure, both the housing and the cover plate are provided with magnets for adhering, and an anti-friction component is provided between the housing and the cover plate.

In some embodiments of the present disclosure, an outer surface of the cover plate is provided with an anti-slip sheet.

In some embodiments of the present disclosure, a plurality of recesses are provided on an inner side wall of the housing.

In some embodiments of the present disclosure, the card pack further includes a hanging clip, which is provided on the outer side wall of the housing.

Compared with the existing technology, the beneficial effects of the present disclosure are:

a card pack according to the present disclosure includes a housing, a pushing mechanism, a cover plate, a mechanical gear, a torsion spring, and a hanging clip, etc. The housing has a storage cavity for storing multiple stacked cards, and the housing is provided with an opening structure that communicated with the storage cavity; the pushing mechanism is provided in the storage cavity of the housing and is connected to adjacent two gears. The pushing mechanism is used to push out the multiple cards from the storage cavity to an outside of the storage cavity; the cover plate is connected to an outer wall of the housing, and the housing is connected to a contact piece. The mechanical gear is placed flat in the housing and connected to the pushing mechanism. The torsion spring is connected to the gear. The hanging clip is connected to the housing. When the cover plate is rotated, inertia generated by sliding causes the torsion spring to be rotated, thereby driving the mechanical gear to rotate. The mechanical gear drives adjacent gears to drive the pushing mechanism, so that the pushing mechanism pushes out the multiple cards from the storage cavity to the outside of the storage cavity.

The housing of the present disclosure is provided with the storage cavity, which can conveniently store multiple cards and effectively organize and protect the cards. The housing provides structural support for the entire card pack, protecting internal cards from external compression and damage. The silicone anti-slip sheet on the housing adopts ergonomic design, rendering the card retrieval effortless, simple and convenient. Using the mechanical gear and torsion spring as a central axis, the cover plate can be rotated and driven by the mechanical gear to easily control the contact piece and achieve rapid card removal. The hanging clip can store change and retrieve it at any time, thereby providing convenience for cash storage. At the same time, it can prevent the card pack from getting stuck on clothing to prevent it from falling off. The structural design of the contact piece can affect the speed and order of the cards that are pushed out, thus meeting different use needs.

BRIEF DESCRIPTION OF DRAWINGS

The specific embodiments of the present disclosure will be further described in detail with reference to the accompanying drawings.

Figure 1:
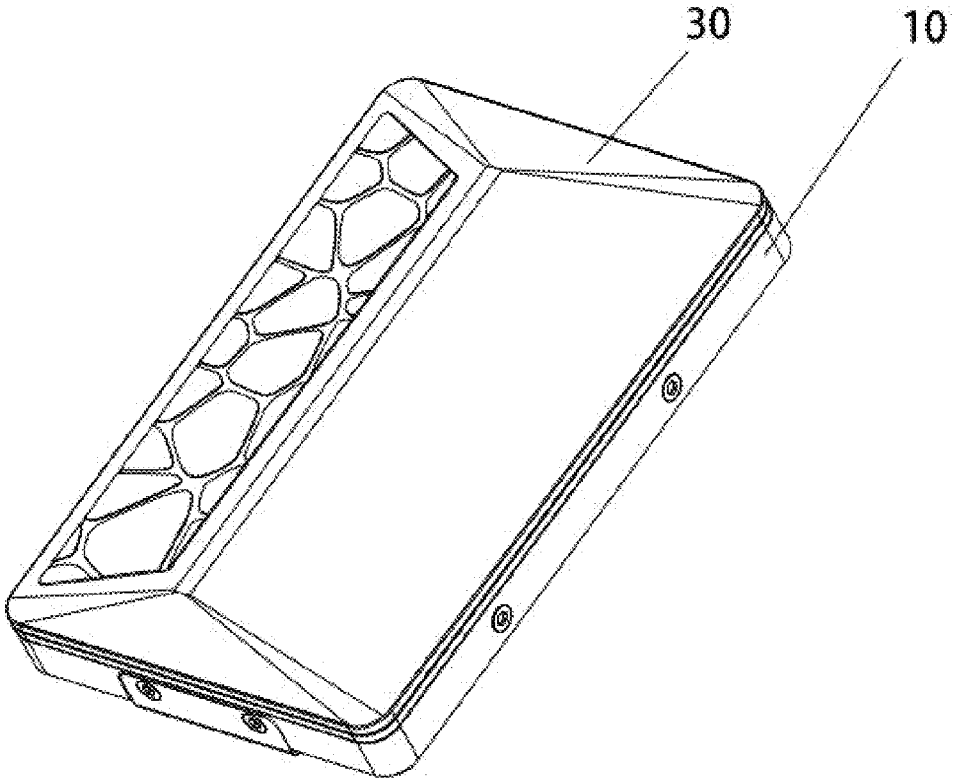
FIG. 1 is a first perspective view of a card pack according to the present disclosure.
Figure 2:
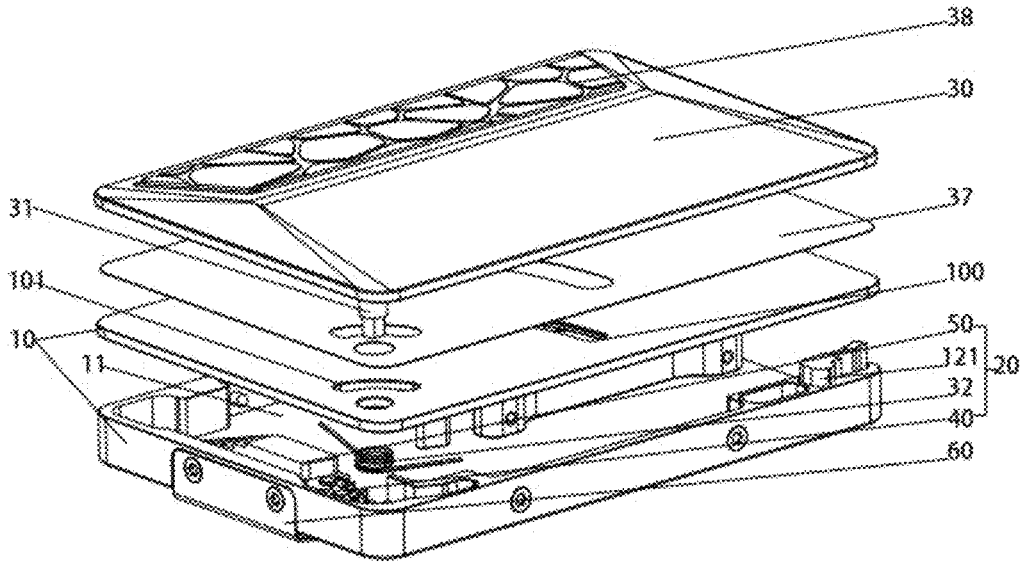
FIG. 2 is a first exploded view of the card pack according to the present disclosure.

Numeral reference: 10-housing, 20-pushing mechanism, 30-cover plate, 40-mechanical gear, 50-swing arm, 60-hanging clip; 11-storage cavity, 12-opening structure, 15-slider installation part, 16-limit block, 19-perforation; 31-transmission shaft, 32-torsion spring, 34-first slider, 35-second slider, 36-magnet, 37-anti-friction component, 38-anti-slip sheet, 39-recess; 51-pushing part; 100-first slide rail, 101-second slide rail; 121-limit piece, 122-contact piece.

DESCRIPTION OF EMBODIMENTS

Preferred embodiments of the present disclosure are described below in combination with the accompanying drawings. It should be understood that the preferred embodiments described herein are only for illustrating and explaining the present disclosure, and are not intended to limit the present disclosure.

As shown in FIGS. 1 to 14, a card pack according to the present disclosure includes a housing 10, a pushing mechanism 20, and a cover plate 30; the housing 10 includes a storage cavity 11 for storing multiple stacked cards, and the housing 10 is provided with an opening structure 12 that communicates with the storage cavity 11; the pushing mechanism 20 is provided in the storage cavity 11 of the housing 10 and is configured to push out the multiple cards from the storage cavity 11 to an outside of the storage cavity 11; the cover plate 30 is connected to an outer side wall of the housing 10 and is connected to the pushing mechanism 20; when the cover plate 30 is rotated, it drives the pushing mechanism 20 to push out the multiple cards from the storage cavity 11 to the outside of the storage cavity 11.

It can be understood that the housing 10 is a main body of the card pack, and the storage cavity 11 is provided in the housing 10 for storing the multiple stacked cards. One side of the housing 10 is provided with the opening structure 12, which is communicated with the storage cavity 11, thereby facilitating the entry and exit of the cards. The pushing mechanism 20 is provided in the storage cavity 11 of the housing 10.

According to the drawings, the pushing mechanism 20 includes a mechanical gear 40, a swing arm 50, and other components. The mechanical gear 40 is connected to the cover plate 30. When the cover plate 30 is rotated, the mechanical gear 40 is driven to rotate, thereby driving the swing arm 50. One end of the swing arm 50 is provided with a pushing part 51, which contacts the cards in the storage cavity 11 and pushes them out one by one through swinging. In an implementation mode, a rotation angle of the mechanical gear 40 can be adjusted by the number of teeth on the gear.

The cover plate 30 is connected to an outer side wall of the housing 10 and connected to the mechanical gear 40 of the pushing mechanism 20. By rotating the cover plate 30, the pushing mechanism 20 can be driven to work, thereby achieving the pushing of the cards.

A working principle of the present disclosure is to sequentially place the multiple cards into the storage cavity 11 for card storage, the cover plate 30 is rotated to drive the pushing mechanism 20 to work. The pushing part 51 of the swing arm 50 contacts with the cards and pushes them out one by one.

Figure 6:
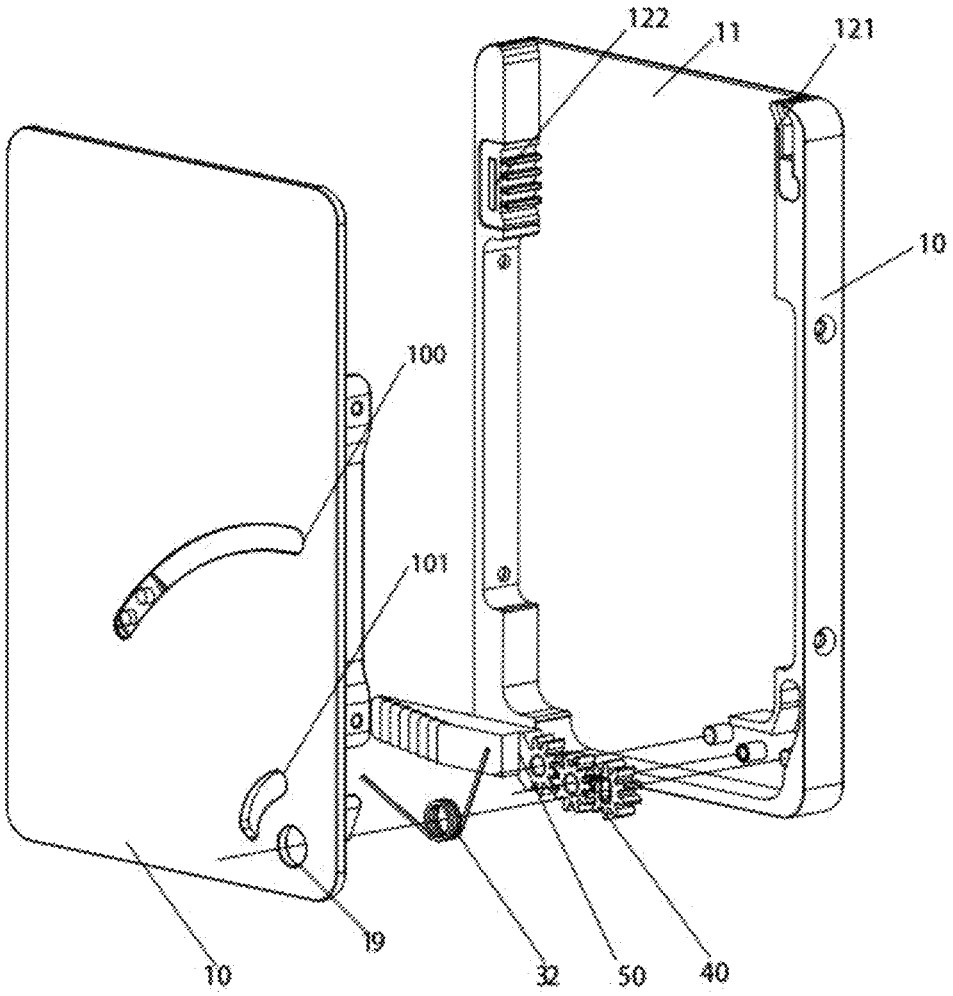
FIG. 6 is a perspective view of a disassembled housing of the card pack according to the present disclosure.

In an implementation mode, as shown in FIG. 6, an inner wall of the opening structure 12 of the housing 10 is connected to a limit piece 121 that can be swung elastically; the limit piece 121 has an avoidance state and a limit state that are mutually switched;

in the avoidance state, the limit piece 121 can allow the cards to be stretched out from the opening structure 12;

in the limit state, the limit piece 121 is configured to prevent the cards from being fallen out of the storage cavity 11.

It can be understood that the housing 10 is a main part of the card pack, and the storage cavity 11 is provided in the housing 10 for storing the multiple stacked cards. One side of the housing 10 is provided with the opening structure 12, which is communicated with the storage cavity 11, thereby facilitating the entry and exit of the cards.

Figure 11:
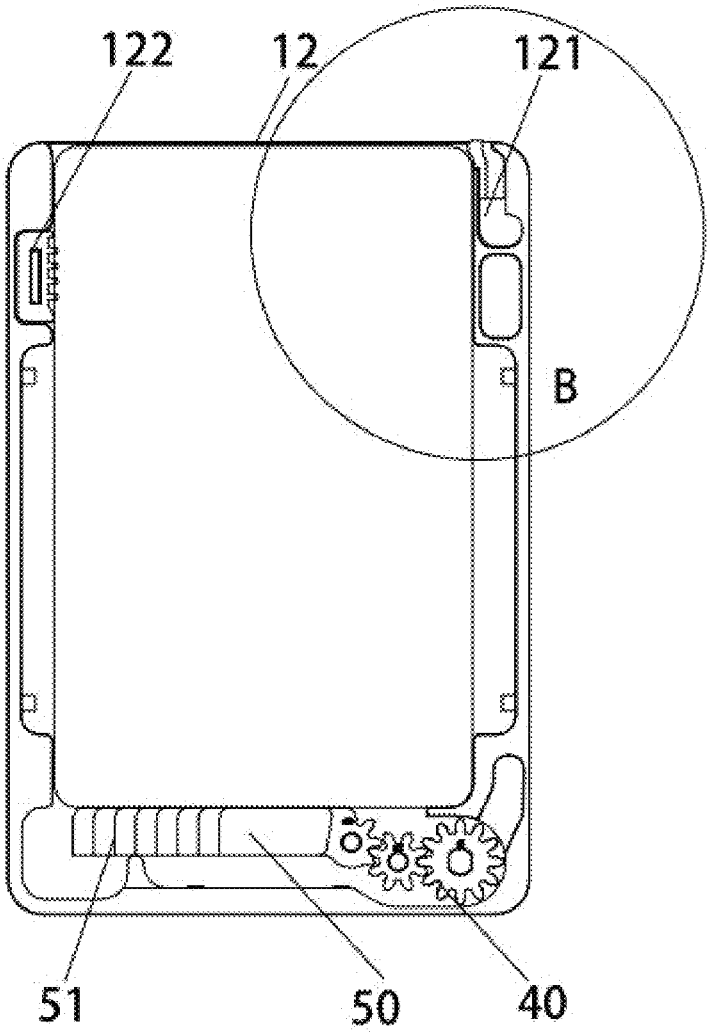
FIG. 11 is a front view of a storage cavity of the card pack according to the present disclosure.
Figure 12:
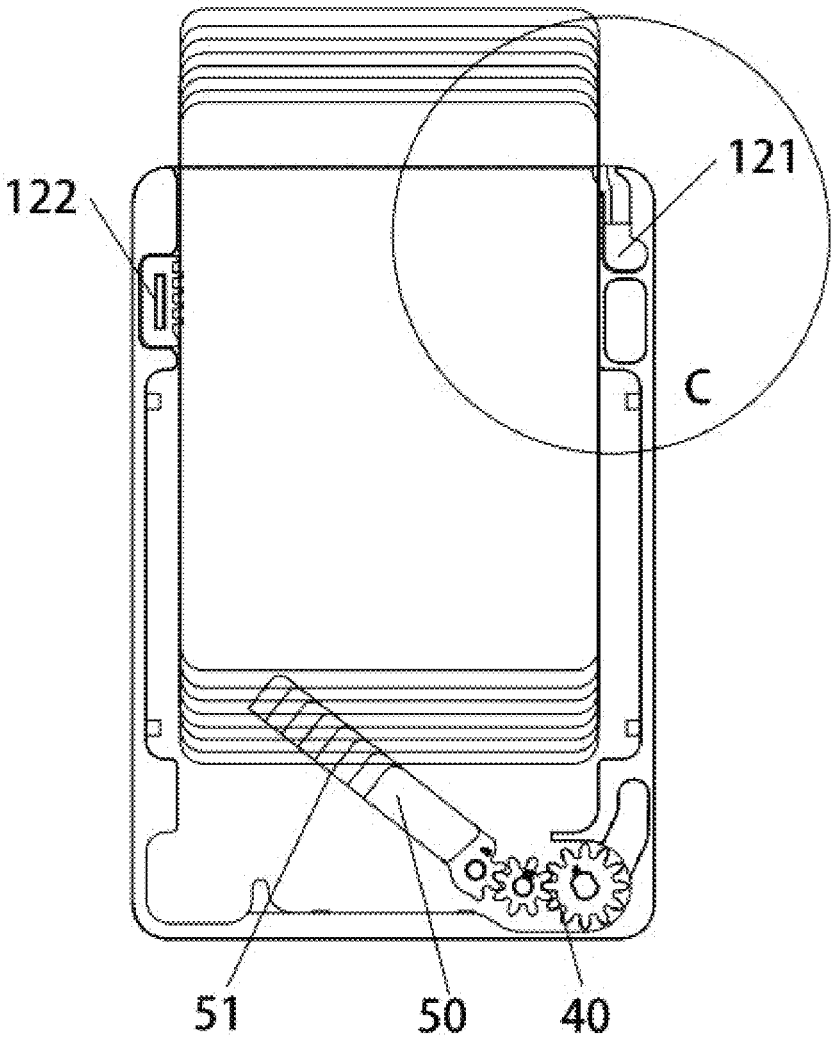
FIG. 12 is a second schematic diagram of the working state of the card pack according to the present disclosure.
Figure 13:
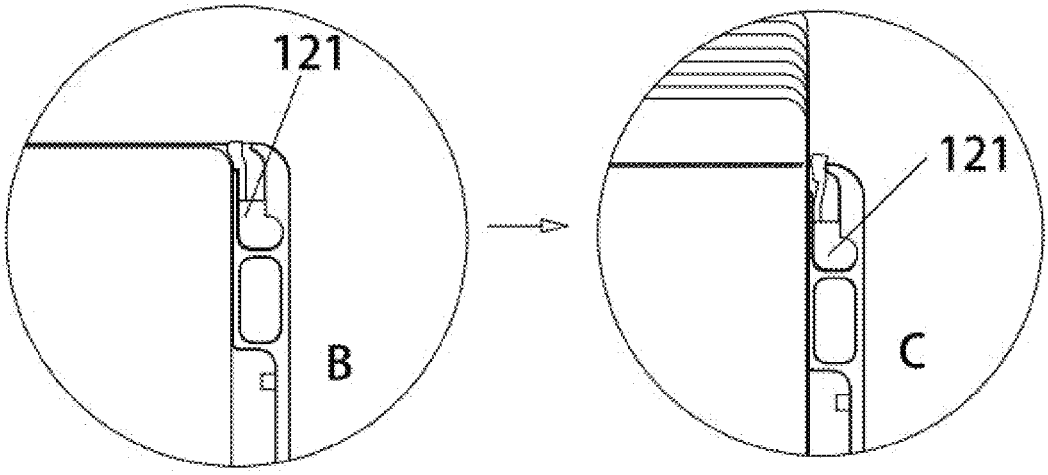
FIG. 13 is a schematic diagram of an avoidance state and a limit state of a limit piece in the card package according to the present disclosure.

Combining FIGS. 11, 12, and 13, the avoidance state: when it is necessary to fetch the cards, the limit piece 121 is in the avoidance state, thereby providing space for the cards to be stretched out from the opening structure 12.

The limit state: after the card storage is completed, the limit piece 121 is switched to the limit state and presses against the cards so as to prevent them from falling out of the storage cavity 11.

In an implementation mode, the multiple cards are placed in the storage cavity 11 in sequence. At this time, the limit piece 121 is in the avoidance state, thereby providing space for the cards. The cover plate 30 is rotated to drive the pushing mechanism 20 to work. The pushing part 51 of the swing arm 50 pushes out the cards one by one. During a pushing process of the cards, the limit piece 121 is still in the avoidance state.

As shown in FIGS. 11 and 12, a side wall of the storage cavity 11 of the housing 10 is connected to a contact piece 122, which is configured to contact side walls of the multiple cards in the storage cavity 11. A friction between the housing 10 and the cards is increased through the contact piece 122.

It can be understood that the contact piece 122 directly contacts the side wall of the cards in the storage cavity 11. The function of the contact piece 122 is to increase the friction between the housing 10 and the cards. When the pushing mechanism 20 pushes out the cards, the cards will not slide easily, ensuring that the cards that are pushed out will not be fall off.

In an implementation mode, the contact piece 122 can protect the cards from wear and tear during multiple uses.

As shown in FIGS. 6, 11, and 12, in an implementation mode, the pushing mechanism 20 includes:

a mechanical gear 40, which is movably connected to the storage cavity 11 of the housing 10 and is connected to the cover plate 30;

a swing arm 50, which is hinged to the housing 10 and engaged with the mechanical gear 40 for transmission, the swing arm 50 has an initial state and a working state;

when the cover plate 30 is rotated and the mechanical gear 40 is driven, the mechanical gear 40 drives the swing arm 50 to switch between a pushing state and a reset state;

when the swing arm 50 is in the initial state, the multiple cards can be fully stored in the storage cavity 11 of the housing 10;

when the swing arm 50 is in the working state, it pushes out the multiple cards from the storage cavity 11 to the outside of the storage cavity 11.

It can be understood that the mechanical gear 40 is fixed in the housing 10 and is connected to the cover plate 30. In an implementation mode, it is connected to a transmission shaft 31 on the cover plate, when the cover plate 30 is rotated, the mechanical gear 40 will also rotate accordingly. One end of the swing arm 50 is hinged to the housing 10, and the other end thereof is engaged with the mechanical gear 40. By driving the mechanical gear 40, the swing arm 50 can be switched between the pushing state and the reset state. One end of the swing arm 50 is provided with a pushing part 51, which directly contacts the cards in the storage cavity 11.

When a user pushes the cover plate 30, it is the working state of the swing arm 50; when the cover plate 30 is retracted, it is the initial state of the swing arm 50.

The working principle of the present disclosure is to sequentially place the multiple cards into the storage cavity 11. At this time, the swing arm 50 is in the initial state, and the pushing part 51 is not in contact with the cards; when the cover plate 30 is rotated, and the mechanical gear 40 is rotated accordingly, the swing arm 50 is driven to move. The pushing part 51 of the swing arm 50 comes into contact with the cards and pushes them out one by one. During the pushing process of the cards, the swing arm 50 is switched from the initial state to the working state. When all cards are pushed out, the swing arm 50 will automatically reset to the initial state.

In an implementation mode, in combination with FIG. 12, the swing arm 50 includes a pushing part 51 with a layered structure. This layered structure causes inconsistent card lengths for each card that is pushed out. The layered structure enables the cards in the storage cavity 11 to be displayed layer by layer in front of the user, thereby improving the visibility and recognition of the cards. The user can quickly browse and select a desired card through the layered structure, thereby improving usage efficiency and convenience.

Figure 4:
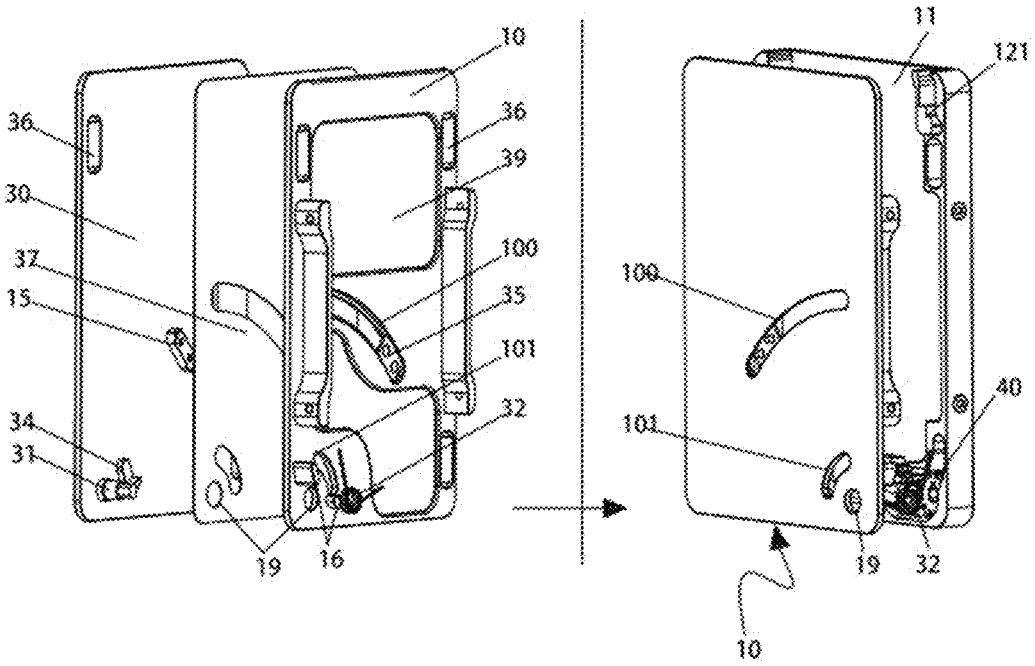
FIG. 4 is an exploded view showing a disassembled structure of the card pack according to the present disclosure.
Figure 5:
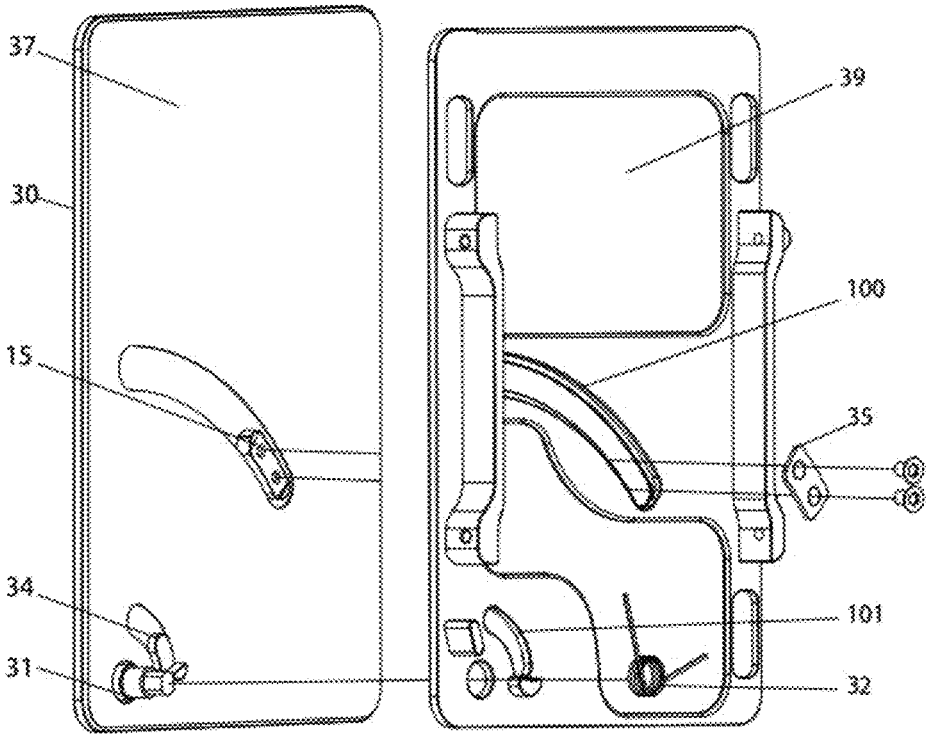
FIG. 5 is a perspective view of a housing and a cover plate of the card pack of the present disclosure.

As shown in FIGS. 4-6, in an implementation mode, the cover plate 30 includes the transmission shaft 31, and the cover plate 30 drives the mechanical gear 40 through the transmission shaft 31;

the transmission shaft 31 is sleeved with a torsion spring 32, the torsion spring 32 abuts against an inner wall of the housing 10. The torsion spring 32 is configured for an elastic reset of the cover plate 30.

It can be understood that, by rotating the cover plate 30, the pushing mechanism 20 can be driven to work and the cards can be pushed out. The transmission shaft 31 runs through the cover plate 30, one end of the transmission shaft 31 is connected to the mechanical gear 40 and the other end thereof is connected to the torsion spring 32. The function of the transmission shaft 31 is to transmit a rotation of the cover plate 30 to the mechanical gear 40, thereby driving the pushing mechanism 20. The torsion spring 32 is sleeved on the transmission shaft 31, and its center is connected to the transmission shaft 31 and the other end thereof abuts against the inner wall of the housing 10. The function of the torsion spring 32 is to provide an elastic restore force for the cover plate 30.

Working principle: when the cover plate 30 is rotated, the transmission shaft 31 is rotated accordingly, the mechanical gear 40 is driven to rotate. The mechanical gear 40 drives the swing arm 50 to push the card. When the cover plate 30 is released, an elastic force of the torsion spring 32 will drive the transmission shaft 31 and the cover plate 30 to return to the initial positions.

Figure 7:
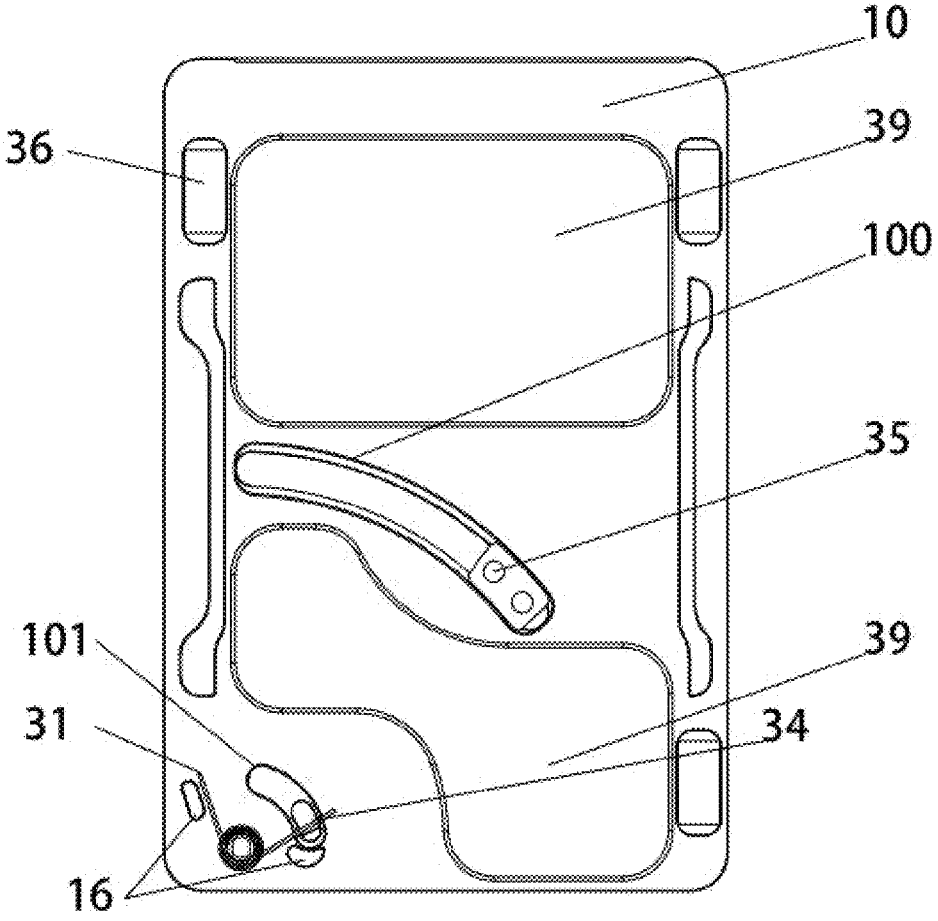
FIG. 7 is a front view of an interior of the housing of the card pack according to the present disclosure.
Figure 8:
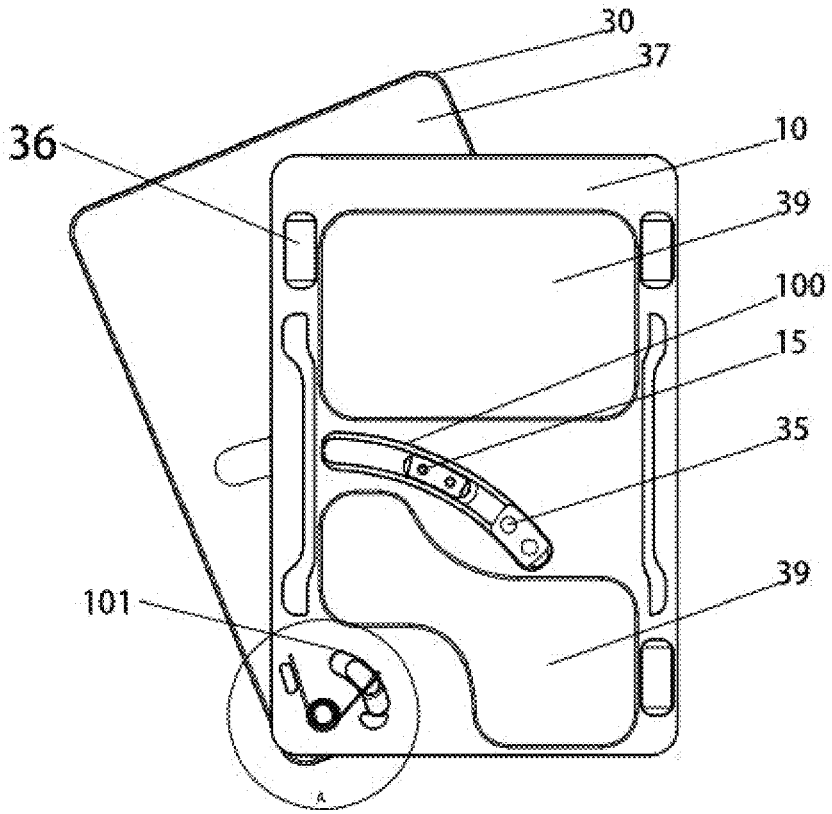
FIG. 8 is a first schematic diagram of a working state of the card pack according to the present disclosure.
Figure 9:
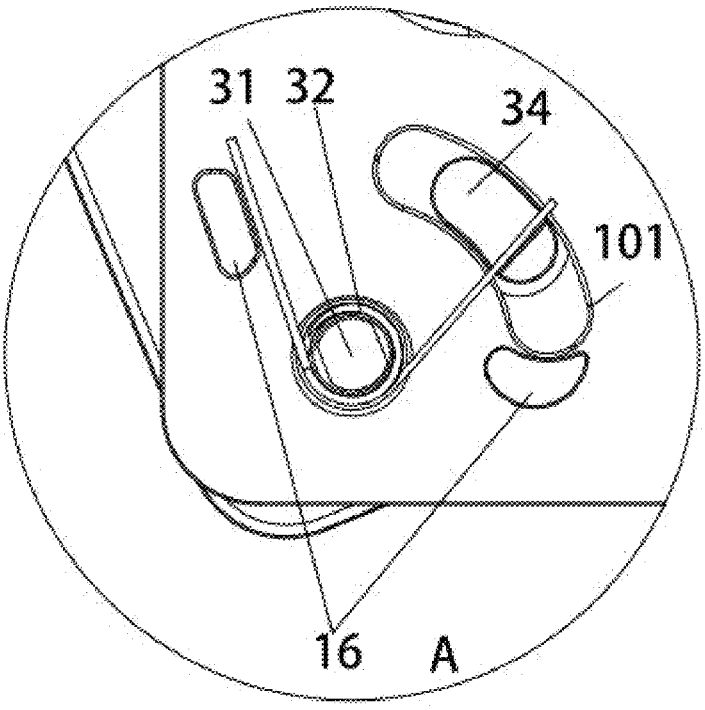
FIG. 9 is an enlarged view of part A of the card pack according to the present disclosure.

Combining with FIGS. 7 and 8, in an implementation mode, the inner wall of the housing 10 abuts against a protrusion, and the protrusion is a limit block 16. One end of the torsion spring 32 is limited by the limit block 16, and the other end of the torsion spring 32 is limited by a first slider 34. When the cover plate 30 is rotated, the first slider 34 shifts and compresses the torsion spring 32.

In an implementation mode, as shown in FIGS. 11 and 12, the swing arm 50 includes a pushing part 51 with a stepped structure; the pushing part 51 has multiple steps, and each step of the pushing part 51 correspondingly contacts one card and pushes it out; when the swing arm 50 is in the working state, the pushing part 51 can render the multiple cards to be stretched out from the storage cavity 11 successively, and render lengths of the multiple cards that are stretched out from the storage cavity 11 are different.

It can be understood that the stepped pushing part 51 is provided on the swing arm 50 of the pushing mechanism 20. This pushing part 51 is composed of multiple steps of different heights, each step corresponds to one card. When the swing arm 50 is moved under a drive of the mechanical gear 40, the steps of different heights will sequentially come into contact with the cards in the storage cavity 11. Due to different heights of receptive one step, when the swing arm 50 is moved, it will push the cards at different positions to different heights. In this way, the multiple cards are simultaneously stretched out from the storage cavity 11, and the length of each card that is stretched out is also different.

In this way, the multiple cards can be simultaneously extended from the storage cavity 11, and an exposed part of each card can be used as a label or identification. A user does not need to take out the cards one by one and can see the information of multiple cards at once.

As shown in FIGS. 5 and 6, in an implementation mode, the housing 10 further includes:

- a perforation 19, the transmission shaft 31 passes through the perforation 19 and is connected to mechanical gear 40,
- a first slide rail 100 and a second slide rail 101 that are arranged in an arc line.

In an implementation mode, the cover plate 30 further includes:

- a slider installation part 15;
- the first slider 34, which is cooperated with the second slide rail 120 to guide the rotation of the cover plate 30.

In an implementation mode, the inner wall of the housing 10 is provided with a second slider 35, which passes through the first slide rail 100 and is connected to the slider installation part 15 on the cover plate 30;

- the second slider 35 is configured to guide the cover plate 30 to slide back and forth along the first slide rail 100 and the second slide rail 101;
- a displacement distance of the cover plate 30 is determined by lengths of the first slide rail 100 and the second slide rail 101.

It can be understood that the perforation 19 is provided on the housing 10 for passing through the transmission shaft 31 and transmitting the rotation of the cover plate 30 to the mechanical gear 40. The first slide rail 100 and the second slide rail 101 arranged in an arc line are provided on an inner side of the housing 10. The second slider 35 works together with the first slider 34 to guide the cover plate 30 to slide back and forth along the first slide rail 100 and the second slide rail 101.

In an implementation mode, the slider installation part 15 is provided on the cover plate 30 for fixing the first slider 34. The first slider 34 is cooperated with the second slide rail 101 to guide the cover plate 30 to rotate along an arc-shaped trajectory.

Working principle: when the user rotates the cover plate 30, the first slider 34 is slid on the second slide rail 101, and the second slider 35 is slid on the first slide rail 100, the cover plate 30 is driven to rotate along the arc-shaped trajectory. The rotation of the cover plate 30 is transmitted to the mechanical gear 40 through the transmission shaft 31, the pushing mechanism 20 is driven to work and achieve the pushing of the cards.

In an implementation mode, as shown in FIGS. 7 and 8, the inner wall of the housing 10 includes the limit block 16;

- the housing 10 is further provided with a plurality of limit blocks 16, one end of the torsion spring 32 is matched with the limit block 16, and the other end of the torsion spring 32 is matched with the first slider 34, the torsion spring 32 is compressed by rotating the cover plate 30;
- when in the working state, the torsion spring 32 is compressed.

It can be understood that the limit block 16 serves as a fixed point for the torsion spring 32, thereby limiting a compression amount of the torsion spring and indirectly limiting a rotation angle of the cover plate 30. The torsion spring 32 provides a rebound force for the cover plate 30, allowing it to automatically reset after being released. At the same time, the compression amount of the torsion spring 32 also affects a resistance of opening the cover plate 30, the first slider 34 is limited by the slide rail, and one end of the slide rail is further provided with the limit block 16 to prevent the torsion spring 32 from being fallen into the card pack due to external reasons, thereby playing a limiting role on the other end of the torsion spring 32. The limit piece limits the compression amount of the torsion spring 32, ensuring that the card pack will automatically rebound after being opened to a certain angle. An automatic reset: the elastic force of the torsion spring 32 enables the cover plate 30 to have an automatic reset function, without a need for manual closure. A smooth operation: a combination of the slide rail and the torsion spring renders the opening and closing of the cover plate 30 smoother.

Figure 10:
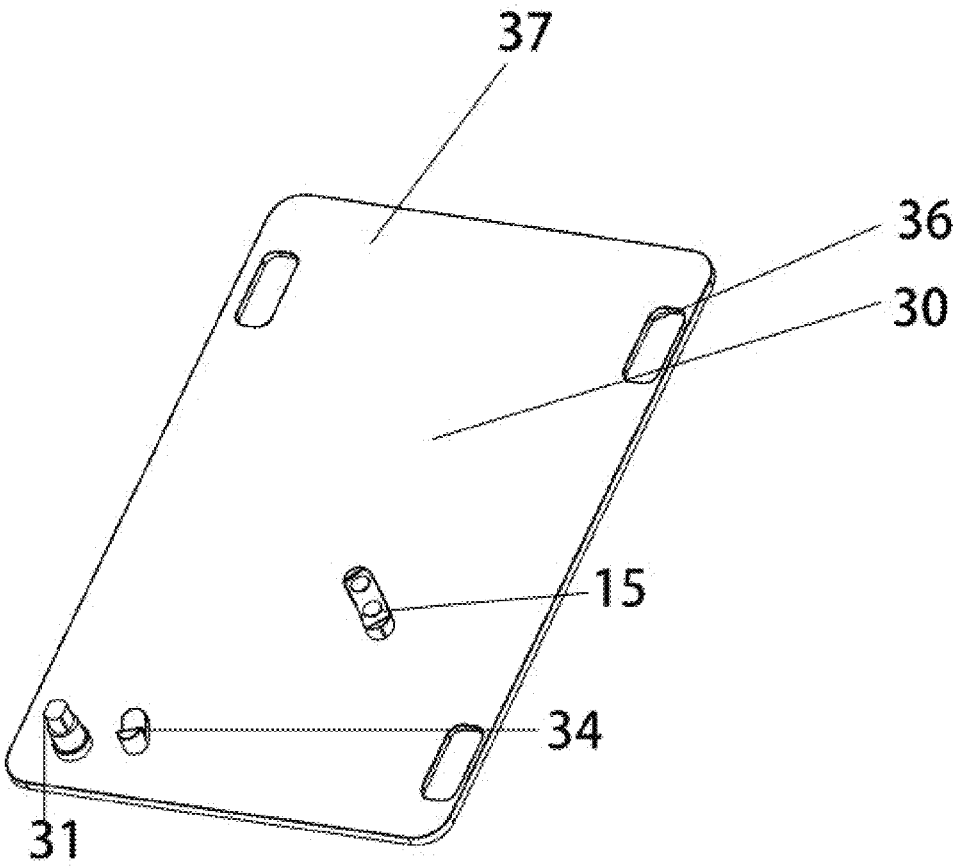
FIG. 10 is a perspective view of a second cover plate of the card pack cooperation with an anti-friction component of the present disclosure.

As shown in FIGS. 4, 5, and 10, in an implementation mode, both the housing 10 and the cover plate 30 are provided with magnets 36 for bonding, and an anti-friction component 37 is provided between the housing 10 and the cover plate 30. The magnets 36 on the housing 10 and the cover plate 30 are attracted to each other, thereby enhancing an adsorption force between the cover plate 30 and the housing 10, rendering the closing of the card pack is more tightly. The anti-friction component 37 is located at a contact surface between the housing 10 and the cover plate 30, reducing the friction between the two and extending the service life of the card pack. The anti-friction component 37 is made of soft rubber, plastic, etc.

When the user closes the cover plate and the housing, the magnets 36 on the housing 10 and the cover plate 30 are attracted to each other, the housing 10 and the cover plate 30 are adhered together. At the same time, the anti-friction component 37 serves as a buffer, reducing friction and protecting the surface of the cover plate.

As shown in FIG. 1, in an implementation mode, an outer surface of the cover plate 30 is provided with an anti-slip sheet 38.

It can be understood that the anti-slip sheet 38 is located on the outer surface of the cover plate 30, and its shape can be regular or irregular concave, and convex patterns on the surface can increase friction with fingers. There are dense small dots like protrusions distributed on the surface, which can enhance the friction; surface structures with good anti-slip properties in nature, such as conchs, leaves, etc., can be imitated. The anti-slip sheet 38 increases contact area and friction between the cover plate 30 and the fingers, thereby preventing the card pack from slipping during use and improving the grip stability of the card pack.

Figure 3:
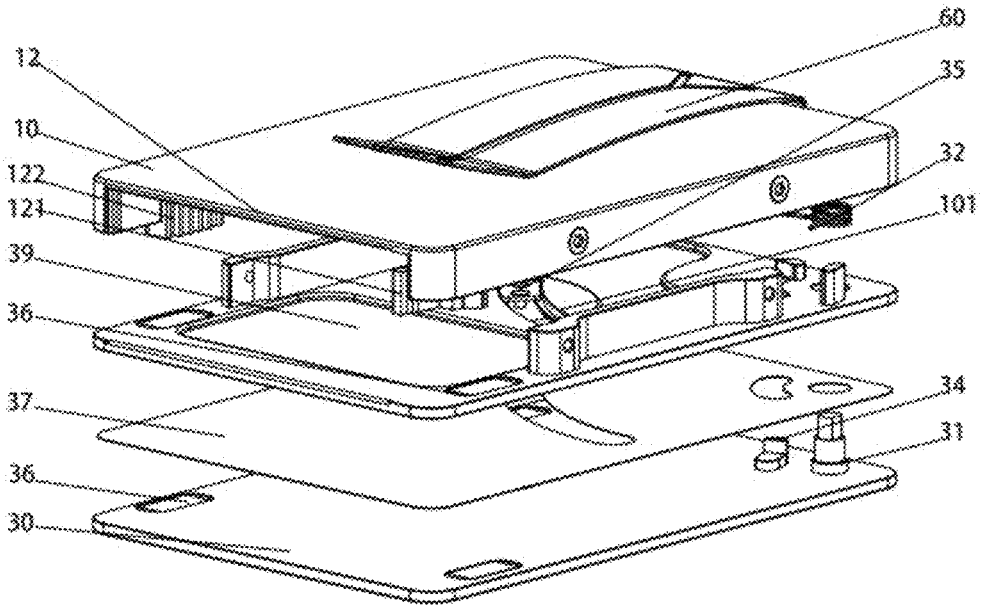
FIG. 3 is a second exploded view of the card pack according to the present disclosure.

As shown in FIGS. 3, 4, and 5, in an implementation mode, an inner side wall of the housing 10 further includes a plurality of recesses 39.

It can be understood that the recesses 39 are distributed in the housing 10, and their shapes can be circular, elliptical, rectangular, etc. The depth and size can be adjusted as needed. By providing the recesses 39 in the housing 10, the amount of material used can be effectively reduced, thereby reducing an overall weight of the card pack and improving its portability.

Figure 14:
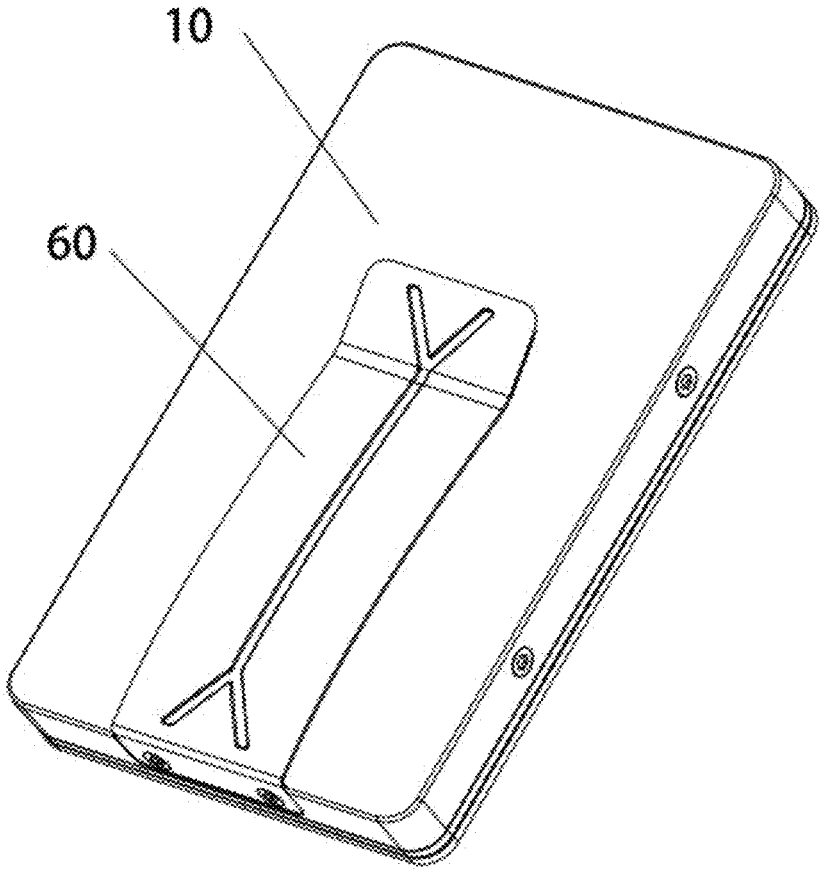
FIG. 14 is a second perspective view of the card pack according to the present disclosure.

As shown in FIG. 14, in an implementation mode, the card pack further includes a hanging clip 60, which is provided on the outer side wall of the housing 10.

In an implementation mode, the hanging clip 60 enables the card pack to be conveniently fixed on the user's waist belt, rendering it easy for the user to carry and use. The user can hang the card pack on his body without having to put it in his pocket or handbag. The hanging clip 60 facilitates the user's access to and placement of the cards, increasing comfort and convenience.

In summary, the card pack in the present disclosure is provided with the storage cavity that can store multiple cards. By the pushing mechanism, the cards can be pushed out one by one, rendering it convenient for the user to access. The opening structure on the housing facilitates the entry and exit of the cards, and also plays a role of fixing the cards to a certain extent. A cooperation between the magnets and the torsion spring ensures smooth opening and closing of the cover plate. The anti-friction component reduces the friction between components and extends the service life of the card pack. The design of the anti-slip sheet, hanging clip, etc. enhances the user experience. The design of recesses reduces the weight of the card pack, and the stepped pushing part improves the visibility of the cards.

The working principle of the card pack described in the present disclosure is that the card package described in the present disclosure achieves a convenient, interesting, and secure card management way through a reasonable mechanical structure design. When the user needs to fetch the card, he only needs to slide the cover plate to drive the slider to move on the slide rail, thereby driving the mechanical gear to rotate. The rotation of the mechanical gear drives the slider to move in the storage cavity, pushing the required card towards the opening. At the same time, the limit piece is in the avoidance state, and the card can be displayed layer by layer in front of the user along the pushing part of the swing arm. And the anti-slip sheet increases the grip, and the hanging clip is easy to carry.

The other structures of the card pack described in this embodiment can be found in the prior art.

The above description is only preferred embodiments of the present disclosure and does not limit the present disclosure in any form. Therefore, any modifications, equivalent changes, and modifications made to the above embodiments based on the technical essence of the present disclosure without departing from the technical solution of the present disclosure still fall within the scope of the technical solution of the present disclosure.

What is claimed is:

1. A card pack, comprising:

a housing, the housing comprises a storage cavity configured to store multiple stacked cards, the housing is provided with an opening structure that communicates with the storage cavity;

a pushing assembly, which is provided in the storage cavity of the housing and is configured to push out the multiple cards from the storage cavity to an outside of the storage cavity;

a cover plate, which is connected at an outer side wall of the housing and is connected to the pushing assembly; when the cover plate is rotated from an initial position, the cover plate drives the pushing assembly to push out the multiple cards from the storage cavity to the outside of the storage cavity;

wherein the pushing assembly comprises:

a first mechanical gear with an oblong through hole and a second mechanical gear meshing therewith, the first mechanical gear is arranged at a corner of the storage cavity of the housing; and a swing arm which is hinged to the housing and has a gear structure at one end, which is meshed with the second mechanical gear for transmission;

the cover plate has a transmission shaft insertable into the oblong through hole of the first mechanical gear for driving the first mechanical gear;

a torsion spring is arranged at the corner and has one end limited by a limit block and the other end limited by a first slider, the torsion spring is configured for driving the transmission shaft and the cover plate to return the cover plate to the initial position.

2. The card pack according to claim 1, wherein an inner wall of the opening structure of the housing is connected with a limit piece that is capable of being swung elastically, and the limit piece has an avoidance state and a limit state that are mutually switched;

in the avoidance state, the limit piece allows the cards to be stretched out from the opening structure;

in the limit state, the limit piece is configured to prevent the cards from being fallen out from the storage cavity.

3. The card pack according to claim 1, wherein a side wall of the storage cavity of the housing is connected to a contact piece, which is configured to contact side walls of the multiple cards in the storage cavity, and a friction between the housing and the cards is increased through the contact piece.

4. The card pack according to claim 1, wherein the swing arm has an initial state and a working state;

when the cover plate is rotated and the first mechanical gear is driven, the first mechanical gear drives the second mechanical gear and accordingly the swing arm to switch between a pushing state and a reset state;

when the swing arm is in the initial state, the multiple cards are stored in the storage cavity of the housing;

when the swing arm is the working state, it pushes out the multiple cards from the storage cavity to the outside of the storage cavity.

5. The card pack according to claim 1, wherein the swing arm comprises a pushing part with multiple steps, each step of the pushing part correspondingly contacts one card and pushes out one card;

when the swing arm is in the working state, the pushing part causes-pushes the multiple cards to be stretched out successively from the storage cavity, and lengths of the multiple cards that are stretched out from the storage cavity are different.

6. The card pack according to claim 1, wherein the housing further comprises:

a first slide rail and a second slide rail that are arranged in an arc line.

7. The card pack according to claim 6, wherein the cover plate further comprises a slider installation part; and the first slider is cooperated with the second slide rail to guide a rotation of the cover plate.

8. The card pack according to claim 7, wherein an interior of the housing is provided with a second slider, which passes through the first slide rail and is connected to the slider installation part on the cover plate;

the second slider is configured to guide the cover plate to slide back and forth along the first slide rail and the second slide rail;

a displacement distance of the cover plate is determined by lengths of the first slide rail and the second slide rail.

9. The card pack according to claim 7, wherein when in the working state, the torsion spring is compressed.

10. The card pack according to claim 1, wherein both the housing and the cover plate are provided with magnets for adhering, and an anti-friction component is provided between the housing and the cover plate.

11. The card pack according to claim 1, wherein an outer surface of the cover plate is provided with an anti-slip sheet.

12. The card pack according to claim 1, wherein a plurality of recesses are provided on an inner side wall of the housing.

13. The card pack according to claim 1, further comprising a hanging clip, which is provided on the outer side wall of the housing.

* * * * *